United States Patent [19]

Notton

[11] 4,139,373

[45] Feb. 13, 1979

[54] ALLOYS OF TITANIUM

[75] Inventor: John H. F. Notton, Wembley, England

[73] Assignee: Johnson, Matthey & Co., Limited, London, England

[21] Appl. No.: 744,023

[22] Filed: Nov. 22, 1976

[30] Foreign Application Priority Data

Nov. 27, 1975 [GB] United Kingdom ..... 48788/75

[51] Int. Cl.[2] ..... C22C 14/00

[52] U.S. Cl. ..... 75/175.5

[58] Field of Search ..... 75/175.5; 174/102 A, 174/126 R; 204/290 F, 293; 219/145; 338/334

[56] References Cited

U.S. PATENT DOCUMENTS

| | | | |
|---|---|---|---|
| 3,063,835 | 11/1962 | Stern | 75/175.5 |
| 3,084,042 | 4/1963 | Wartel et al. | 75/175.5 X |
| 3,111,406 | 11/1963 | Kaarlela | 75/175.5 |
| 3,129,163 | 4/1964 | Stern | 75/175.5 X |
| 4,007,107 | 2/1977 | Johnson | 204/293 |

FOREIGN PATENT DOCUMENTS

| | | | |
|---|---|---|---|
| 1186454 | 4/1970 | United Kingdom | 204/290 F |

OTHER PUBLICATIONS

Z. Metallkde, Bd 54 (1963), H. 8, pp. 455–459, Raub et al.

Z. Metallkde, Bd 59 (1968), H. 2, pp. 112–114.

Nuclear Sci. Abstracts, vol. 17, Jan. 15, 1963, p. 75, Abstract No. 528.

*Primary Examiner*—L. Dewayne Rutledge

*Assistant Examiner*—Peter K. Skiff

*Attorney, Agent, or Firm*—Cushman, Darby & Cushman

[57] ABSTRACT

This invention relates to titanium alloys consisting, apart from impurities, of 60 to 94 weight % titanium and 6 to 40 weight % of at least one additional metal selected from the group consisting of iridium, rhodium, ruthenium, platinum and palladium. Alloys according to this invention possess corrosion rates lower than those of titanium metal alone and they are eminently suitable for carrying electric current.

1 Claim, No Drawings

ALLOYS OF TITANIUM

This invention relates to titanium alloys. Alloys according to this invention possess corrosion rates lower than those of titanium metal alone and they are eminently suitable for carrying electric current. Because of its lightness and strength titanium is often in demand as a material of construction but an objection to the known alloys of titanium is their high corrosion rate when used for applications requiring alternating current at high current density.

It is known that when certain other elements, for example, molybdenum, manganese, aluminium and vanadium, are alloyed with titanium, improved corrosion resistant current carrying capacity is obtained.

Corrosion resistance has also been increased in non-oxidising corrosive media, for example, hydrochloric and sulphuric acids, by alloying titanium with molybdenum in amounts up to 25% by weight; but this causes metallic embrittlement rendering the alloy difficult to fabricate with an attendant reduction in its resistance to oxidising conditions. Other methods of increasing corrosion resistance include the addition of passivating inhibitors to the environment so as to anodically polarise the metal into the so-called "passive potential region" and anodically protect the titanium by applying an external current. The titanium could also be made thermodynamically stable in a corrosive environment by plating with platinum but this is expensive and difficult to accomplish with large items of equipment.

According to the present invention an alloy suitable for use as a current carrying electrode or conductor comprises a titanium alloy containing one or more additional metals selected from the group consisting of iridium, rhodium, ruthenium, platinum and palladium, the said additional metals being present in an amount ranging from 6% to 40% by weight of the alloy. Preferably, the additional metal(s) are present in an amount ranging from 6% to 15% by weight. The alloys of the present invention may be prepared by methods known in the art and the constituents may be in any commercially available pure form.

EXAMPLE

The following table shows typical corrosion properties of electrodes carrying 240 V AC, 50 cycles per second with a current density of 0.33 A/cm$^2$.

| Metal or Alloy. | Corrosion Rate micrograms/cm$^2$/hr. |
|---|---|
| Titanium | 1400 |
| Palladium | 150 |
| 6% Palladium/Ti | 30 |
| Platinum | 50 |
| 6% Platinum/Ti | 100 |
| 6% Platinum/6% Iridium/Ti | 150 |
| 6% Iridium/Ti | 200 |

All percentages are by weight.

It will be seen from the above examples that the addition of the platinum group metal or metals reduces the corrosion rate and is thus useful when used for applications requiring alternating current at high current density where the corrosion rate of the electrode is usually high. An example of one such application would be to use the alloy of the present invention as electrodes in water heaters.

What I claim is:

1. A titanium-based alloy consisting, apart from impurities of 88 weight % titanium, 6 weight % platinum and 6 weight % iridium, said alloy being characterized by its low corrosion rate when used as an electrode with alternating current at a high current density.

* * * * *